US008516766B2

(12) United States Patent
Kuznetsov

(10) Patent No.: US 8,516,766 B2
(45) Date of Patent: Aug. 27, 2013

(54) PANEL FOR DECORATING SPACES

(76) Inventor: Viacheslav Maratovich Kuznetsov, Sankt-Peterburg (RU)

( * ) Notice: Subject to any disclaimer, the term of this patent is extended or adjusted under 35 U.S.C. 154(b) by 69 days.

(21) Appl. No.: 12/928,543

(22) Filed: Dec. 14, 2010

(65) Prior Publication Data

US 2011/0138728 A1 Jun. 16, 2011

(30) Foreign Application Priority Data

Dec. 14, 2009 (RU) ..... 2009146525

(51) Int. Cl.
*E04B 2/00* (2006.01)

(52) U.S. Cl.
USPC ..... 52/588.1; 52/589.1; 52/590.2; 52/592.1

(58) Field of Classification Search
USPC ..... 52/588.1, 384, 578, 36.5, 589.1, 52/590.2, 591.2, 591.4, 592.1, 592.3, 592.6
See application file for complete search history.

(56) References Cited

U.S. PATENT DOCUMENTS 3,145,502 A * 8/1964 Rubenstein ..... 52/223.7
6,379,077 B1 * 4/2002 Camber et al. ..... 403/367
2002/0189183 A1 * 12/2002 Ricciardelli ..... 52/390

* cited by examiner

*Primary Examiner* — William Gilbert
*Assistant Examiner* — Patrick Maestri
(74) *Attorney, Agent, or Firm* — Henry M. Feiereisen, LLC

(57) ABSTRACT

A panel for decorating spaces has a first structural element and a second structural element connected with one another, wherein the first structural element on lateral sides is provided with pins, while the second structural element on a back side is provided with shaped slots with a depression corresponding to the pin.

5 Claims, 2 Drawing Sheets

PANEL FOR DECORATING SPACES

BACKGROUND OF THE INVENTION

The present invention relates to a decorating of inner surfaces of spaces, preferably of walls and ceilings.

Panels and linings for decoration of spaces are known in the art. Some of them are disclosed in patents on utility models RU45150; RU39624; RU39625; RU10198, and also patents on inventions RU2348774 and 2338855. They are based on connection of identical elements by means of a pin engaging in a slot. The disadvantage of such constructions is that it is necessary to consecutively dismount structural elements, starting from an edge element in the case when it is necessary to dismount one of the elements, for example when it is no longer usable or when it is no longer or when it is necessary to have an axis to hidden communications.

SUMMARY OF THE INVENTION

Accordingly, it is an object of the present invention to provide a panel for decoration of spaces which eliminates the disadvantages of the prior art.

More particularly, it is an object the present invention to provide a panel for decorating spaces which allows dismounting and mounting of a structural element without dismounting of adjoining structural elements.

In keeping with these objects and with others which will become apparent hereinafter, one feature of the present invention resides, briefly stated, in a panel for decorating of spaces which has pins and shaped slots and includes a first structural element connected with a second structural element, pins are formed on lateral sides of the first structural element, and in the second structural element on its back side there are shaped slots with a depression corresponding to the pin.

As a result, the second structural element which is suspended between neighboring first structural elements can be easily dismounted when needed, and mounted again without dismounting of the neighboring first structural elements. In addition, the first structural element, which is released from the neighboring second structural elements also can be temporarily mounted and replaced when needed.

In accordance with an embodiment of the present invention, a vertical projection is formed on the end of the pins, and an edge of the depressions, which corresponds to the projection, the vertical recess is provided, which prevents shifting of the neighboring structural elements relative to one another in a horizontal direction.

In accordance with another embodiment, decorative elements are formed on the face side of the panel.

In accordance with a further embodiment, the first structural element and the second structural element are formed as 3-layers. This provides in particular a technical formation of shaped elements by gluing of the layers.

In accordance with still a further embodiment of the present invention, the first structural element and the second structural element can be formed preferably of a hard natural material, or of a synthetic material based on polyvinyl chloride.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
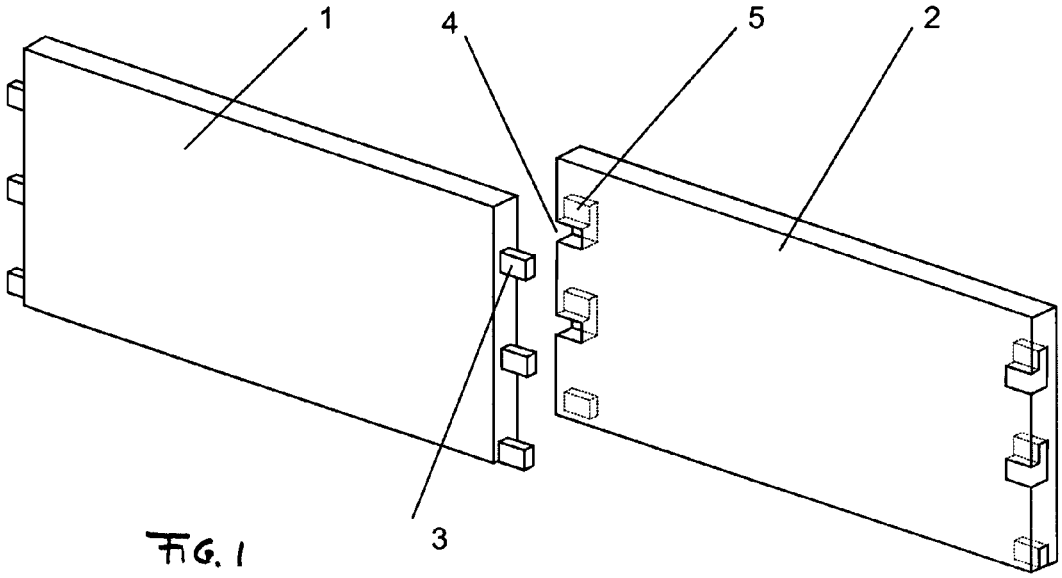
FIG. 1 is a view from behind of a panel for decorating spaces in accordance with the present invention.
Figure 2:
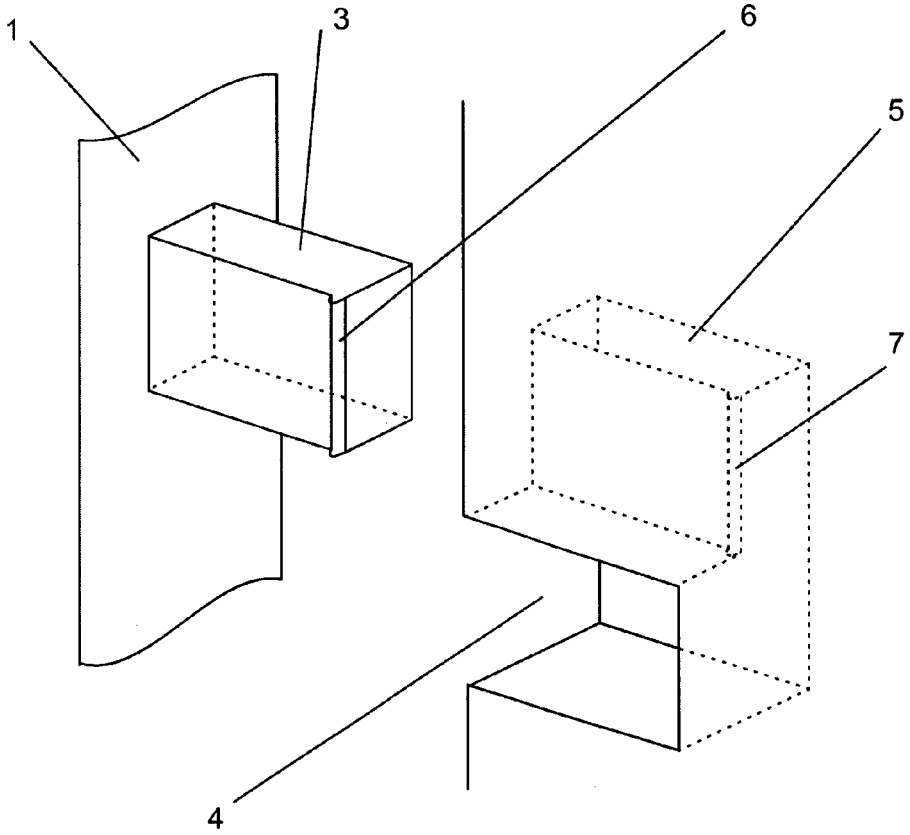
FIG. 2 is a view showing a fragment of a first structural element with a pin and a fragment of a second structural element with a shaped slot.
Figure 3:
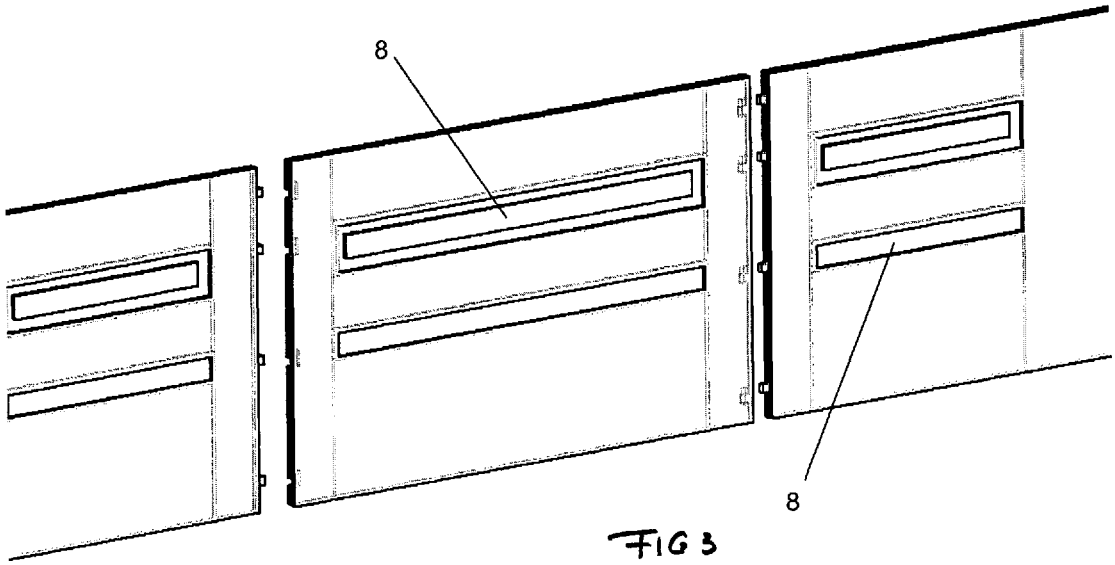
FIG. 3 is a front view showing lining composed of two first structural elements with decorative elements; and a second structural element with decorative elements.
Figure 4:
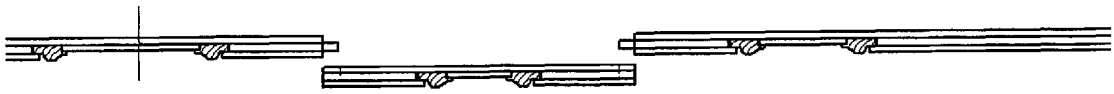
FIG. 4 is a view from above showing a lining composed of two first structural elements and one second structural element.

A panel in accordance with the present invention includes a first structural element which is identified as a whole with reference numeral 1 and a second structural element which is identified as a whole with reference numeral 2.

The first structural element 1 and second structural element 2 can be made of a composition based for example on polyvinyl chloride.

The first structural element 1 is provided on its sides with a row of pins 3, while the second structural elements 2 on its back side is provided with a shaped slots 4 with a depression 5.

A vertical projection 6 is formed on the end of the pins 3, while a vertical depression 7 is formed on the edge of the depressions 5 in correspondence with the projection 6.

The depressions 5 have a shape corresponding to the shape of the pins 3.

Decorative elements 8 are formed on the side of the first structural element 1 and the second structural element 2.

The panels are placed in the following manner.

First on a marked surface to be lined two first structural elements 1 are fixed by known fixing means. It is preferable to use hidden fixing means arranged on the back side of the panel. The second structural element 2 is suspended between two first structural elements 1 by a motion "forward and downward". The pins 3 engage in corresponding slots 4 and become located in the depressions 5.

With the use of the opposite motion "upward and backward", the second structural element 2 can be dismounted when needed. The vertical projection 6, interacting with the vertical depression 7 additionally fixes the structure in a horizontal direction.

A few first structural elements 11 and the second structural elements 2 which alternate with one another in this way, together form the required lining.

It will be understood that each of the elements described above, or two or more together, may also find a useful application in other types of methods and constructions differing from the type described above.

While the invention has been illustrated and described as embodied in panel for decorating spaces, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A panel for decorating spaces, comprising a first flat structural element and a second flat structural element each having a larger flat face surface and a larger flat back surface extending in a vertical direction, a narrower upper surface and a narrower lower surface extending in a horizontal direction between said flat face and back surfaces, and a narrower left side surface and a narrower right side surface extending vertically between said flat face and back surfaces perpendicular to them, wherein said first and second flat structural elements are connected with one another so that their vertically extending side surfaces face each other, wherein said first flat structural element is provided on each of its vertically extending side surfaces with a plurality of pins which have flat surfaces, are spaced from one another in a vertical direction and extend toward said second flat structural element, wherein each of said pins on a face side is provided with a vertical projection which projects from said pin transversely to said pin and narrows to form a sharp vertical edge, wherein said second flat structural element at each of its vertically extending side surfaces has a plurality of slots each extending from said vertically extending side surface away from said first structural element and being open at said larger flat face surface of said second flat structural element and also has a plurality of depressions each located vertically above a corresponding one of said slots in communication therewith and being closed from said larger face surface of said second flat structural element, wherein each of said depressions is provided with a vertical recess extending transversely to a corresponding one of said depressions and narrowing to form a sharp vertical edge substantially corresponding to said vertical projection, so that in order assemble said first and second flat structural elements with one another, said first and second flat structural elements are moved toward one another, said pins of said first flat structural element are introduced into said slots of said second flat structural element, said first and second flat structural elements are shifted transversely and vertically relative to one another, said pins of said first flat structural element are introduced into said depressions of said second flat structural element, said sharp-edged vertical projections of said pins are introduced into said sharp-edged vertical recesses of said depressions, whereupon said first and second flat structural elements can no longer be separated from one another by moving them horizontally away from each other.

2. A panel as defined in claim 1, further comprising decorative elements provided on face sides of said first structural element and said second structural element.

3. A panel as defined in claim 1, wherein said first structural element and said second structural element are composed of a plurality of layers.

4. A panel as defined in claim 1, wherein said first structural element and said second structural element are composed of a material selected from the group consisting of a synthetic material based on polyvinyl chloride and a rigid natural material.

5. A panel as defined in claim 1, further comprising a plurality of said first and second structural elements.

* * * * *